US012366372B2

(12) United States Patent
Bailey

(10) Patent No.: US 12,366,372 B2
(45) Date of Patent: Jul. 22, 2025

(54) HUMIDIFIER WITH CROSSFLOW FAN

(71) Applicant: GENERAL FILTERS, INC., Novi, MI (US)

(72) Inventor: Joshua David Bailey, Novi, MI (US)

(73) Assignee: General Filters, Inc., Novi, MI (US)

( * ) Notice: Subject to any disclaimer, the term of this patent is extended or adjusted under 35 U.S.C. 154(b) by 285 days.

(21) Appl. No.: 18/159,489

(22) Filed: Jan. 25, 2023

(65) Prior Publication Data

US 2024/0247821 A1 Jul. 25, 2024

(51) Int. Cl.
*F24F 6/04* (2006.01)
*F24F 13/20* (2006.01)

(52) U.S. Cl.
CPC ..... *F24F 6/043* (2013.01); *F24F 13/20* (2013.01); *F24F 2013/205* (2013.01)

(58) Field of Classification Search
CPC ..... F24F 6/043; F24F 13/20; F24F 2013/205; F24F 6/04
USPC ..... 261/106, DIG. 15
See application file for complete search history.

(56) References Cited

U.S. PATENT DOCUMENTS

| | | | | |
|---|---|---|---|---|
| 3,339,902 | A * | 9/1967 | Warner | F24F 6/04 261/80 |
| 3,965,691 | A | 6/1976 | Van Huis | |
| 4,612,777 | A | 9/1986 | Noma et al. | |
| 4,994,211 | A | 2/1991 | Fuller | |
| 6,354,572 | B1 | 3/2002 | Menassa | |
| 6,575,436 | B2 | 6/2003 | Litz | |
| 8,302,943 | B2 | 11/2012 | Wang et al. | |
| 8,448,697 | B2 | 5/2013 | Morioka et al. | |
| 8,794,603 | B2 | 8/2014 | Quam et al. | |
| 9,303,649 | B2 | 4/2016 | Ikeda et al. | |
| 10,823,433 | B2 | 11/2020 | Cho et al. | |
| 2003/0183955 | A1 * | 10/2003 | Fields | F23D 14/68 261/106 |
| 2007/0209373 | A1 | 9/2007 | Taira et al. | |
| 2011/0057047 | A1 | 3/2011 | Watanabe et al. | |
| 2012/0171013 | A1 | 7/2012 | Ohtsuka et al. | |

(Continued)

FOREIGN PATENT DOCUMENTS

| | | | |
|---|---|---|---|
| CN | 108709275 | B | 2/2020 |
| KR | 1020060089775 | A * | 8/2006 |
| WO | 2021212861 | A1 | 10/2021 |

OTHER PUBLICATIONS

English Machine Translation of KR 20060089775 A (Year: 2006).*

(Continued)

*Primary Examiner* — Charles S Bushey
(74) *Attorney, Agent, or Firm* — Young Basile Hanlon & MacFarlane, P.C.

(57) ABSTRACT

A humidifier assembly includes a crossflow fan located in an air flow chamber at a lateral side of the air flow chamber and extends along a fan axis that is oriented in a generally vertical direction. The crossflow fan has elongate blades that extend generally parallel to the fan axis in an array around the fan axis to define an interior space along the fan axis. The crossflow fan is configured to define an inlet area at which the air is drawn from the air flow chamber into the interior space through the elongate blades, and to define an outlet area at which the air is expelled from the interior space toward the outlet through the elongate blades.

20 Claims, 4 Drawing Sheets

(56) References Cited

U.S. PATENT DOCUMENTS

| | | | |
|---|---|---|---|
| 2012/0177477 | A1 | 7/2012 | Shiraichi et al. |
| 2020/0278123 | A1 | 9/2020 | Kumra et al. |

OTHER PUBLICATIONS

Thermolec, Pro-600 Humidifier Owner's Instructions, Nov. 18, 2002.
Thermolec, Pro 600 Humidifier Installation Instructions, Revised Version, Jul. 2005.
Desert Spring, Pro 600 Humidifier Installation Instructions, Version 5, Aug. 2007.

* cited by examiner

HUMIDIFIER WITH CROSSFLOW FAN

TECHNICAL FIELD

This disclosure relates to flow-through humidifiers used with forced air systems.

BACKGROUND

A flow-through humidifier may be used with a forced air heating system. A flow-through humidifier may be attached to a duct of the forced air heating system, and the flow-through humidifier is configured to draw hot air from the duct and into the humidifier. The hot air flows through the flow-through humidifier and re-enters the duct downstream from where it entered. The flow-through humidifier includes a vapor pad that is configured to receive water, and the hot air flows through the vapor pad such that the water from the vapor pad evaporates into the hot air, thereby increasing the humidity of the hot air as it re-enters the duct.

SUMMARY

One aspect of the disclosure is a humidifier assembly that is configured to humidify air by flow of the air through a humidifier pad that is formed from a porous material and adapted to absorb water, the humidifier assembly comprising. The humidifier assembly includes a water supply assembly that is configured to supply the water to a top end of the humidifier pad so that the water may flow through the porous material of the humidifier pad from the top end of the humidifier pad toward a bottom end of the humidifier pad. A chassis is configured to be coupled to an HVAC duct and defines an inlet to receive the air from the HVAC duct and an outlet to return the air to the HVAC duct. The chassis also defines a humidifier pad chamber that is configured to support the humidifier pad within the humidifier pad chamber such that a first side of the humidifier pad faces toward the inlet and a second side of the humidifier pad faces away from the inlet. The chassis is configured to allow the air from the HVAC duct to enter the humidifier pad chamber through the inlet so that the air may flow through the humidifier pad from the first side of the humidifier pad to the second side of the humidifier pad during flow of the air through the humidifier pad chamber to humidify the air by contact of the air with the water in the humidifier pad. An intermediate panel is coupled to the chassis and defines openings. A fan cover is coupled to the intermediate panel to define an air flow chamber between the fan cover and the intermediate panel, and the air flow chamber extends between a first lateral side and a second lateral side. The air enters the air flow chamber from the humidifier pad chamber through the openings in the intermediate panel. A crossflow fan is located in the air flow chamber at the second lateral side of the air flow chamber and extends along a fan axis that is oriented in a generally vertical direction. The crossflow fan has elongate blades that extend generally parallel to the fan axis in an array around the fan axis to define an interior space along the fan axis. The crossflow fan is configured to define an inlet area at which the air is drawn from the air flow chamber into the interior space through the elongate blades, and to define an outlet area at which the air is expelled from the interior space toward the outlet through the elongate blades.

Another aspect of the disclosure is a humidifier assembly that is configured to humidify air by flow of the air through a humidifier pad that is formed from a porous material and adapted to absorb water. The humidifier assembly includes a water supply assembly that is configured to supply the water to a top end of the humidifier pad so that the water may flow through the porous material of the humidifier pad from the top end of the humidifier pad toward a bottom end of the humidifier pad. A chassis is configured to be coupled to an HVAC duct and defines an inlet to receive the air from the HVAC duct and an outlet to return the air to the HVAC duct. The chassis also defines a humidifier pad chamber and is configured to support the humidifier pad within the humidifier pad chamber. An intermediate panel is coupled to the chassis and defines openings. The intermediate panel is coupled to the chassis by hinges that define a generally vertical rotation axis for the intermediate panel to allow the intermediate panel to move with respect to the chassis between a closed position and an open position. The hinges include an upper hinge positioned vertically above a lower hinge and define a vertical space between the upper hinge and the lower hinge. A fan cover is coupled to the intermediate panel to define an air flow chamber between the fan cover and the intermediate panel. The air flow chamber extends between a first lateral side and a second lateral side, and the air enters the air flow chamber from the humidifier pad chamber through the openings in the intermediate panel. A crossflow fan is located in the air flow chamber at the second lateral side of the air flow chamber and extends along a fan axis that is oriented in a generally vertical direction. The crossflow fan has elongate blades that extend generally parallel to the fan axis in an array around the fan axis to define an interior space along the fan axis. The crossflow fan is configured to define an inlet area at which the air is drawn from the air flow chamber into the interior space through the elongate blades, and an outlet area at which the air is expelled from the interior space toward the outlet through the elongate blade. The crossflow fan and the fan cover are coupled to the intermediate panel such that they move with the intermediate panel between the closed position and the open position.

Yet another aspect of the disclosure is a humidifier assembly that is configured to humidify air by flow of the air through a humidifier pad that is formed from a porous material and adapted to absorb water, the humidifier assembly comprising. A chassis is configured to be coupled to an HVAC duct and defines an inlet to receive the air from the HVAC duct and an outlet to return the air to the HVAC duct. The chassis defines a humidifier pad chamber and is configured to support the humidifier pad within the humidifier pad chamber such that a first side of the humidifier pad faces toward the inlet and a second side of the humidifier pad faces away from the inlet. The chassis is configured to allow the air from the HVAC duct to enter the humidifier pad chamber through the inlet so that the air may flow through the humidifier pad from the first side of the humidifier pad to the second side of the humidifier pad during flow of the air through the humidifier pad chamber to humidify the air by contact of the air with water in the humidifier pad. An intermediate panel is coupled to the chassis and defines openings. A fan cover is coupled to the intermediate panel to define an air flow chamber between the fan cover and the intermediate panel, and the air flow chamber extends between a first lateral side and a second lateral side. The air enters the air flow chamber from the humidifier pad chamber through the openings in the intermediate panel. A depth of the air flow chamber, measured between the fan cover and the intermediate panel, increases from the first lateral side to the second lateral side of the air flow chamber. A crossflow fan is located in the air flow chamber at the second lateral side of the air flow chamber and extends along a fan axis that is oriented in a generally vertical direction. The crossflow fan has elongate blades that extend generally parallel to the fan axis in an array around the fan axis to define an interior space along the fan axis The crossflow fan is configured to define an inlet area at which the air is drawn from the air flow chamber into the interior space through the elongate blades, and to define an outlet area at which the air is expelled from the interior space toward the outlet through the elongate blades.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Embodiments disclosed herein are directed to a flow-through humidifier with a crossflow fan to direct air from an air duct through a vapor pad, and then return the air to the air duct. The crossflow fan is arranged at a lateral side of an air flow chamber through which the hot air flows and is oriented in a generally vertical direction. The crossflow fan includes elongate blades arranged in an array around a longitudinal axis of the crossflow fan and extend along the longitudinal axis.

Figure 1A:
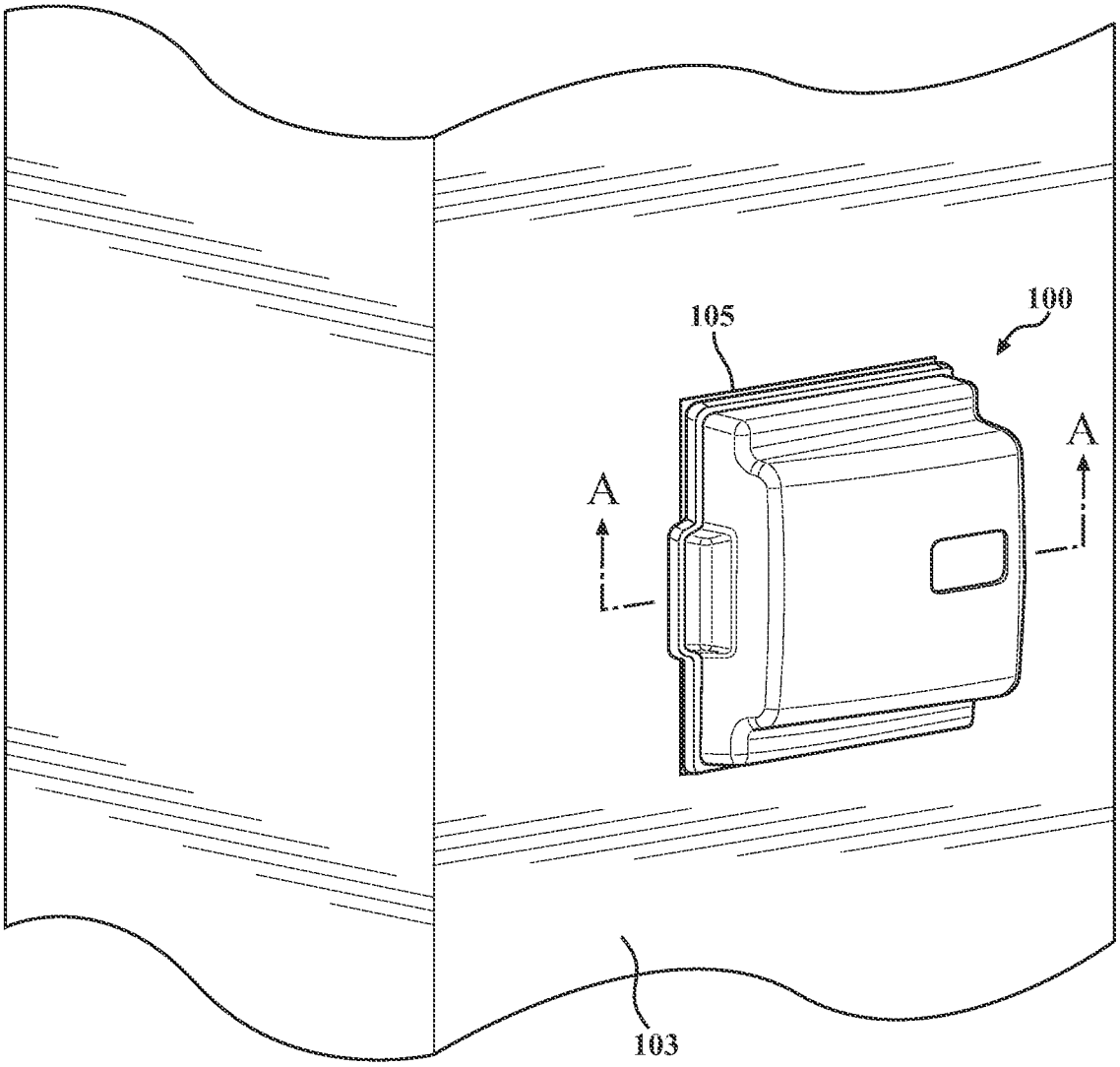
FIG. 1A is an illustration of a humidifier assembly coupled to a heating, ventilation, and air conditioning (HVAC) duct.
Figure 1B:
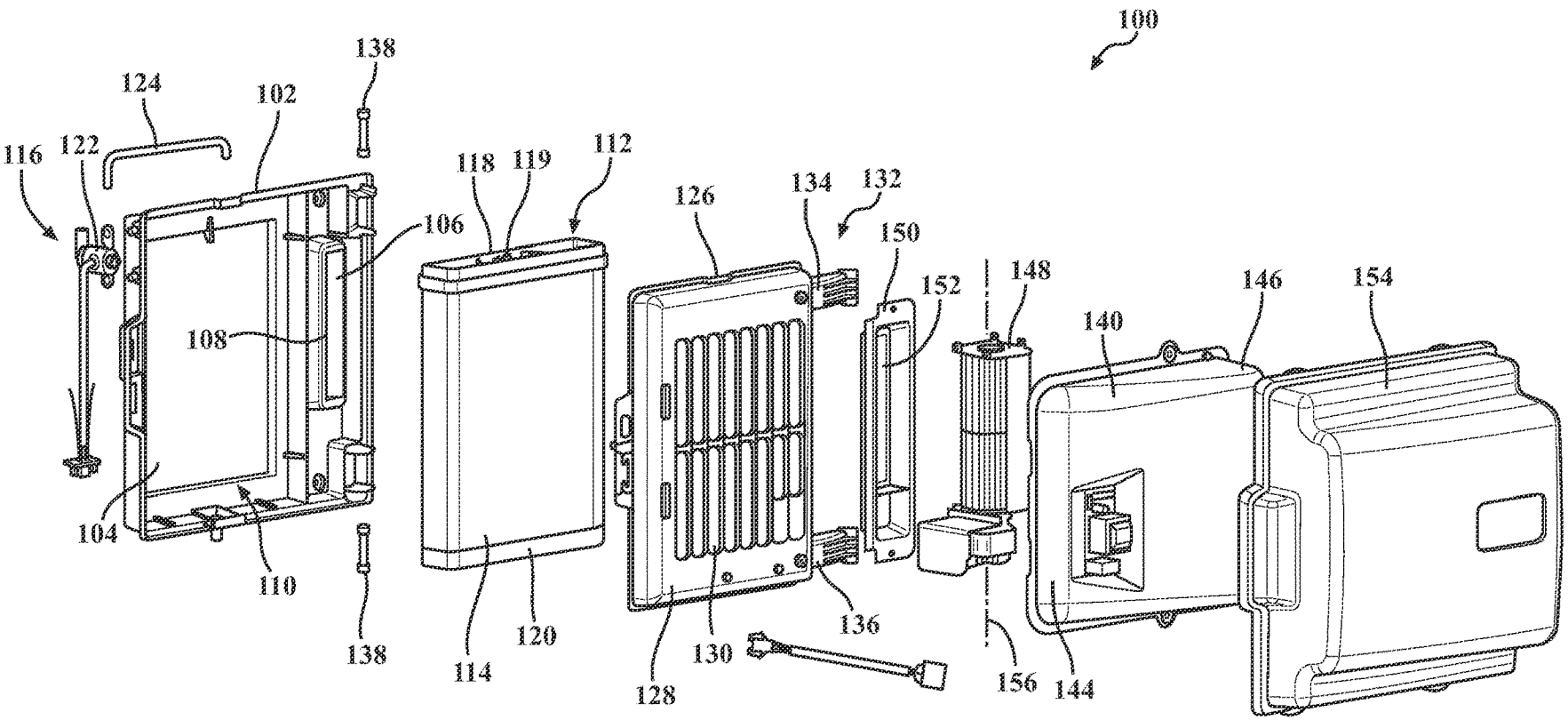
FIG. 1B is an exploded view of the humidifier assembly of FIG. 1A.

FIG. 1A is an illustration of a humidifier assembly 100 coupled to an HVAC duct 103. FIG. 1B is an exploded view of the humidifier assembly 100. The humidifier assembly 100 is shown to include a chassis 102. The chassis 102 is configured to be coupled to the HVAC duct 103 and defines an inlet 104 configured to receive air from the HVAC duct 103 via an outlet 105 of the HVAC duct 103 and an outlet 106 configured to return the air to the HVAC duct 103. In some implementations, the inlet 104 is rectangularly shaped. In some implementations, the outlet 106 is rectangularly shaped with a long side 108 of the outlet 106 oriented in a generally vertical (e.g., within plus or minus ten degrees of perfectly vertical) direction. The outlet 106 may include various geometric configurations in other implementations. As shown, the outlet 106 is laterally offset from the inlet 104, such that the inlet 104 and the outlet 106 are positioned in a side-by-side configuration in the lateral direction with respect to each other.

The inlet 104 may have an area that is larger than an area of the outlet 106. As an example, the outlet 106 may have a height that is between 25% and 75% of a height of the inlet 104, and the outlet 106 may have a width that is between 10% and 25 percent of a width of the inlet 104. Thus, in some implementations, the area of the outlet 106 is less than 25% of the area of the inlet 104. In addition, the outlet 106 may be a single contiguous outlet that is configured to be the sole structure through which the air is returned to the HVAC duct 103, such that the chassis 102 lacks additional outlets.

The chassis 102 further defines a humidifier pad chamber 110 and is configured to support a humidifier pad 112 within the humidifier pad chamber 110. The humidifier pad 112 may be formed from a porous material (e.g., paper, metal, clay-coated metal, foam, cellulose, etc.) that is adapted to absorb water. The humidifier pad chamber 110 supports the humidifier pad 112 such that a first side (not shown) of the humidifier pad 112 faces toward the inlet 104 and a second side 114 of the humidifier pad 112 faces away from the inlet 104. Arranged as described, the chassis 102 is configured to allow the air from the HVAC duct 103 to enter the humidifier pad chamber 110 through the inlet 104 so that the air may flow through the humidifier pad 112 from the first side of the humidifier pad 112 to the second side 114 of the humidifier pad 112 when air is flowing through the humidifier pad chamber 110. Accordingly, the air is humidified when the air contacts the water in the humidifier pad 112. To allow contact between the air from the HVAC duct 103 and the water in the humidifier pad 112, the area of the inlet 104 may be similar to the area of the first side of the humidifier pad 112. In some implementations, the area of the inlet 104 is between 80% and 100% of the area of the first side of the humidifier pad 112. This configuration provides a large area through which the air from the HVAC duct 103 may flow through the humidifier pad 112.

The humidifier assembly 100 is further shown to include a water supply assembly 116 that is configured to supply the water to a top end 118 of the humidifier pad 112 so that the water may flow through the humidifier pad 112 from the top end 118 toward a bottom end 120 of the humidifier pad 112. The water supply assembly 116 includes a valve 122 positioned between and in fluid communication with a water source (e.g., water pipe, reservoir, etc.) and a conduit 124, and the valve 122 is configured to limit the flow of water from the water source to the conduit 124. In some implementations, the valve 122 is a two-position valve that is configured to selectively permit or block the flow of the water from the water source to the conduit 124 according to an operating signal supplied to the valve 122. In some implementations, the valve 122 is a proportional valve that is configured to permit passage of the water from the water source to the conduit 124 at a desired flow rate (e.g., between zero percent and one hundred percent, inclusive) according to an operating signal supplied to the valve 122. For example, the valve 122 may be a solenoid valve that is controlled to allow the water to flow from the water source, through the conduit 124, and to the top end 118 of the humidifier pad 112 when the humidity of the air is less than a lower threshold value. To control operation of the valve 122, the valve 122 may be in electrical communication with a humidity sensor (e.g., a humidistat) that generates a signal indicative of the humidity of the air. When the humidity drops below the lower threshold value, the valve 122 opens and allows water to flow from the water source to the conduit 124. Alternatively, the valve 122 may be in electrical communication with a controller that outputs an operating signal for the valve 122 dependent upon a signal indicative of the humidity of the air from a humidity sensor. The conduit 124 is configured to direct the water to the top end 118 of the humidifier pad 112, where the water is supplied to the humidifier pad 112 by a distribution structure 119 (e.g., a distribution trough) that spreads the supply of the water across the lateral and longitudinal dimension of the humidifier pad 112. In some implementations, when the humidity rises above an upper threshold value, the valve 122 closes and limits the water flowing from the water source to the conduit 124. The opening and closing of the valve 122 may also be based on a duration, where the valve 122 remains open for a specified duration after the humidity drops below the lower threshold value.

The humidifier assembly 100 also includes an intermediate panel 126 that is coupled to the chassis 102. The intermediate panel 126 is positioned with respect to the chassis 102 such that the humidifier pad 112 is disposed between the inlet 104 of the chassis 102 and the intermediate panel 126. The intermediate panel 126 includes a panel surface 128 that defines openings 130 that extend through the intermediate panel 126. The openings 130 may be rectangularly shaped and extend in a generally vertical direction. In some implementations, the openings 130 may have other geometric shapes that extend in other directions (e.g., generally horizontal, oblique, etc.). The openings 130 are configured to permit flow of the air through the intermediate panel 126 after the air passes through the second side 114 of the humidifier pad 112. Thus, the air that passes through the openings 130 has been humidified by contact with the water in the humidifier pad 112.

The intermediate panel 126 is coupled to the chassis 102 by hinges 132 that define a generally vertical rotation axis for the intermediate panel 126 to allow the intermediate panel 126 to move with respect to the chassis 102 between a closed position and an open position. The hinges 132 include an upper hinge 134 positioned vertically above a lower hinge 136 and define a vertical space between the upper hinge 134 and the lower hinge 136. The vertical space between the upper hinge 134 and the lower hinge 136 accommodates the outlet 106, which is located in this area at a lateral side of the intermediate panel 126 and the openings 130 that extend therethrough. In some implementations, the hinges 132 may be coupled to the chassis 102 via pins 138. For example, the hinges 132 may be arranged to define a cylindrical opening configured to receive the pins 138. The chassis 102 may include coupling portions configured to receive both the hinges 132 and the pins 138 to couple the chassis 102 to the intermediate panel 126. As another example, the hinges 132 may include c-shaped portions configured to receive mating rods coupled to the chassis 102, and the c-shaped portions are configured to rotate around the mating rods to facilitate rotation of the intermediate panel 126 relative to the chassis 102.

The humidifier assembly 100 includes a fan cover 140 that is coupled to the intermediate panel 126 to define an air flow chamber 142 (shown in FIGS. 2-3) between the fan cover 140 and the intermediate panel 126. The air flow chamber 142 extends between a first lateral side 144 of the fan cover 140 and a second lateral side 146 of the fan cover 140. Air enters the air flow chamber 142 from the humidifier pad chamber 110 through the openings 130 in the intermediate panel 126. Furthermore, the fan cover 140 is coupled to the intermediate panel 126 such that the fan cover 140 moves with the intermediate panel 126 between the closed position and the open position.

A crossflow fan 148 is located in the air flow chamber 142 at the second lateral side 146 of the air flow chamber 142 and extends along a fan axis 156 that is oriented in a generally vertical direction. The crossflow fan 148 is positioned in lateral alignment with the outlet 106 and is laterally offset from the inlet 104. The crossflow fan 148 is coupled to the intermediate panel 126 (via the fan cover 140) such that the crossflow fan 148 moves with the intermediate panel 126 between the closed position and the open position. The crossflow fan 148 is configured to pull the air from the HVAC duct 103 through the inlet 104 such that the air flows through the humidifier pad 112 and is directed to the outlet 106 by the crossflow fan 148. The crossflow fan 148 is further described with respect to FIG. 2.

The humidifier assembly 100 also includes a flow director 150 that is coupled to the fan cover 140. The flow director 150 is positioned in the space between the upper hinge 134 and the lower hinge 136 and has a flow opening 152 that is configured to interface with the outlet 106. The flow director 150 is further described with respect to FIG. 2.

A housing 154 is coupled to the intermediate panel 126 such that the housing 154 moves with the intermediate panel 126 between the closed position and the open position. In the closed position, the housing 154 and the chassis 102 are configured to enclose the humidifier pad 112, the intermediate panel 126, the fan cover 140, the crossflow fan 148, and the flow director 150.

Figure 2:
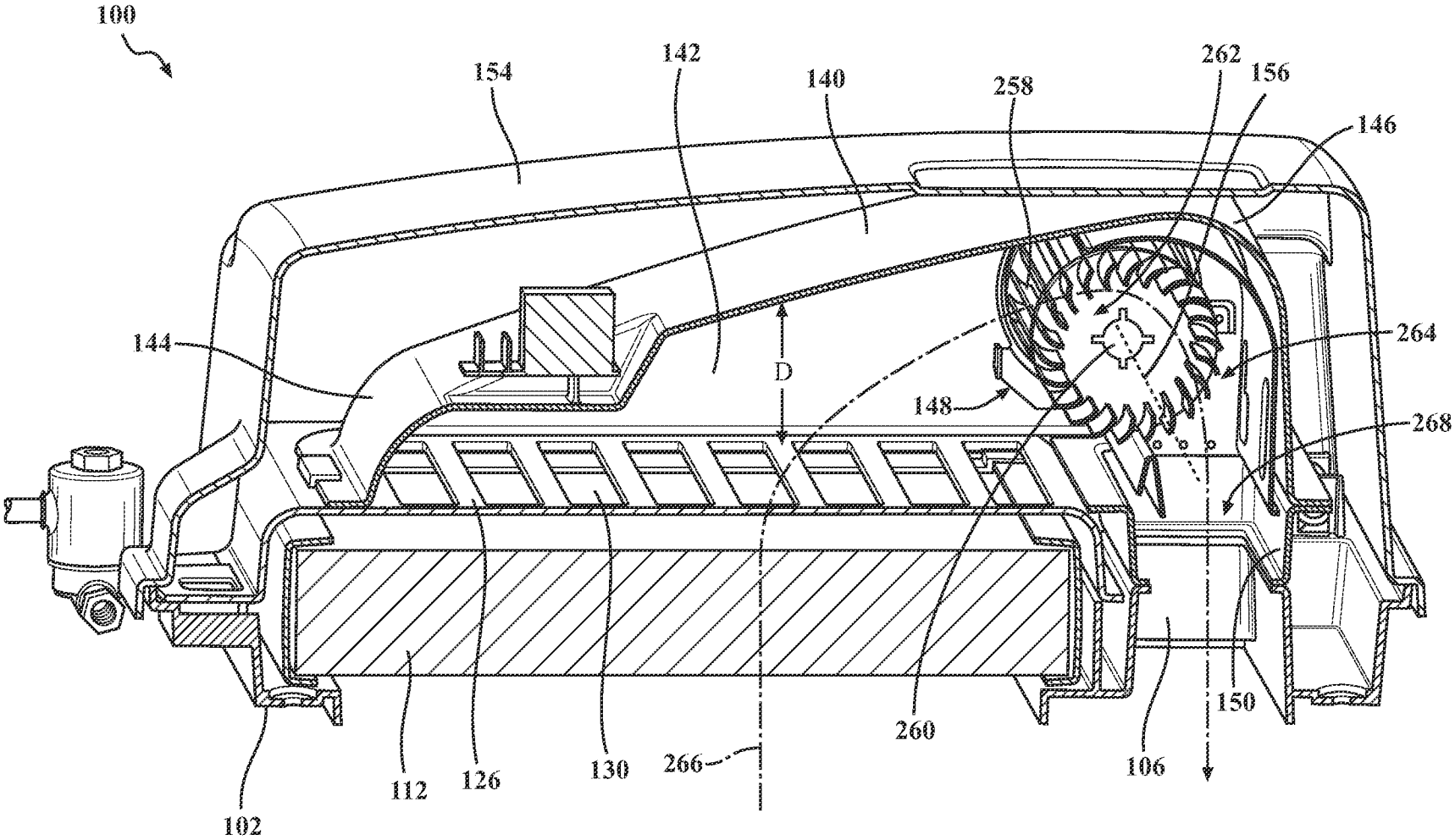
FIG. 2 is a cross-sectional view of the humidifier assembly of FIG. 1A.

FIG. 2 is a cross-sectional view of the humidifier assembly 100 of FIG. 1B taken across line A-A shown in FIG. 1A. As shown, the crossflow fan 148 has elongate blades 258 that extend generally parallel to the fan axis 156 and are arranged in an array around the fan axis 156 to define an interior space 260 along the fan axis 156. The elongate blades 258 are rotated by an electric motor that receives power from a power supply when the crossflow fan 148 is operating. The crossflow fan 148 is defines an inlet area 262 at which the air is drawn from the air flow chamber 142 into the interior space 260 through the elongate blades 258. For example, as the elongate blades 258 rotate around the fan axis 156, the elongate blades 258 draw the air into the interior space 260. The elongate blades 258 and surrounding structures of the crossflow fan 148 are configured to draw the air into the interior space 260 of the crossflow fan 148 in response to rotation of the crossflow fan 148 such that the air flows from the air flow chamber 142 into the interior space 260 in a generally radial direction relative to the fan axis 156. The crossflow fan 148 further defines an outlet area 264 at which the air is expelled from the interior space 260 toward the outlet 106 through the elongate blades 258. The elongate blades 258 and surrounding structures of the crossflow fan 148 are configured to expel the air out of the interior space 260 of the crossflow fan 148 in response to rotation of the crossflow fan 148 such that the air flows from the interior space 260 toward the flow director 150 and the outlet 106 of the chassis 102 in a generally radial direction relative to the fan axis 156.

The crossflow fan 148 draws the air into the air flow chamber 142 from the inlet 104 such that the air generally follows the air flow path 266. The air enters the air flow chamber 142 and is pulled toward the crossflow fan 148 by rotation of the elongate blades 258. The air flows through the interior space 260 and is directed through the outlet area 264 toward the flow director 150. The flow director 150 is coupled to the fan cover 140 and is located adjacent to the outlet area 264. In some implementations, the outlet area 264 extends into the flow director 150 to direct the air from the outlet area 264 into the flow director 150. The flow director 150 has a flow opening 268 that is configured to interface with the outlet 106 such that the air is directed from the crossflow fan 148 to the outlet 106 through the flow opening 268 of the flow director 150.

As shown, a depth D of the air flow chamber 142, measured between the fan cover 140 and the intermediate panel 126, increases from the first lateral side 144 to the second lateral side 146. In some embodiments, the fan cover 140 is shaped such that D increases approximately linearly from the first lateral side 144 to the second lateral side 146.

The fan cover 140 may also be shaped such that D may increase nonlinearly from the first lateral side 144 to the second lateral side 146. For example, the fan cover 140 may have a concave or convex shape, may have a stepped configuration, or may have another geometric shape that causes D to increase nonlinearly from the first lateral side 144 to the second lateral side 146.

Figure 3:
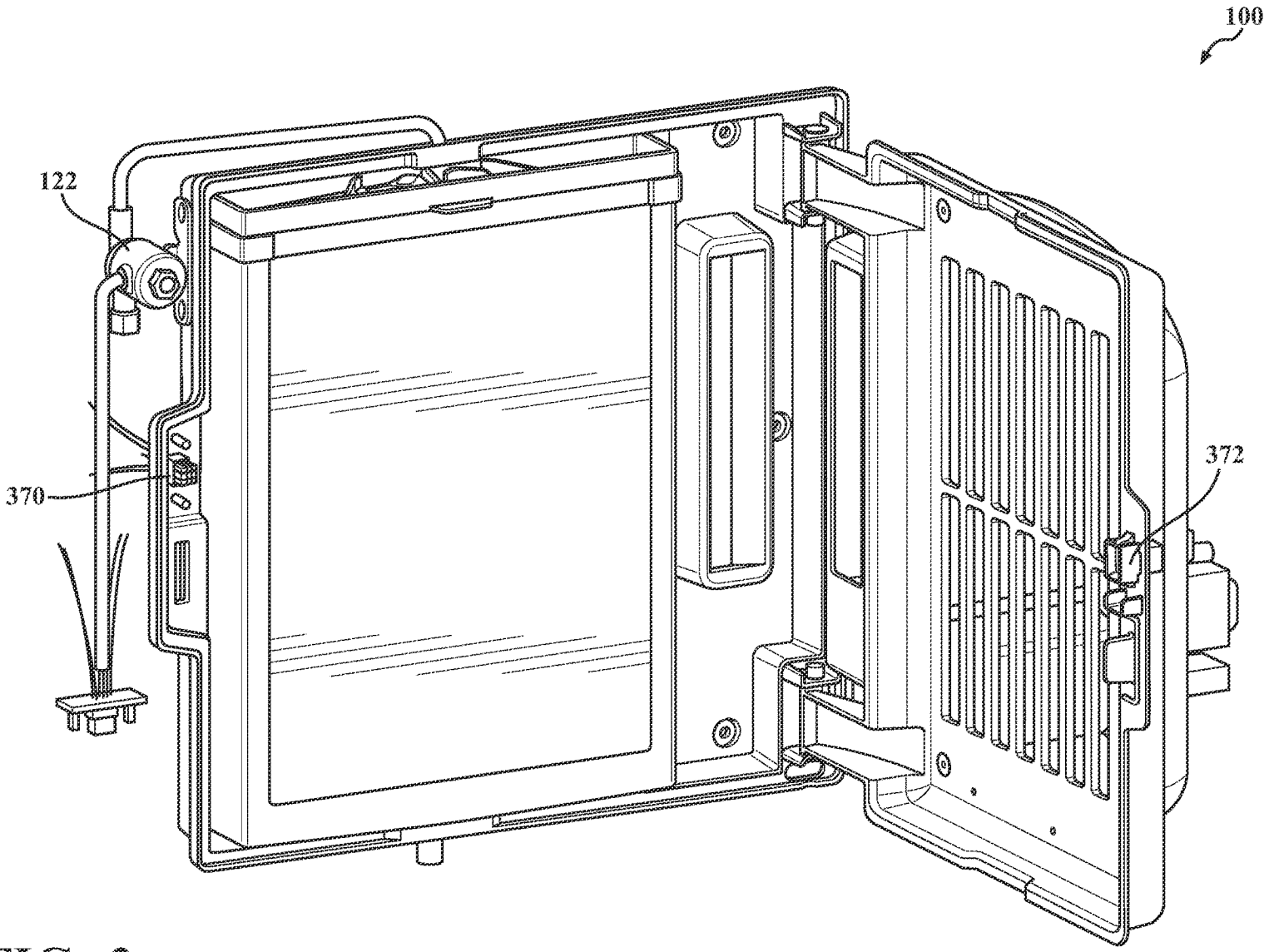
FIG. 3 is an assembly view of the humidifier assembly of FIG. 1A.

FIG. 3 is an assembly view of the humidifier assembly 100 of FIGS. 1A-1B. The humidifier assembly 100 is shown to include a first electrical connector portion 370 that is coupled to the chassis 102. The first electrical connector portion 370 is positioned on the opposite side of the chassis 102 from where the hinges 132 are coupled to the chassis 102. The humidifier assembly 100 is shown to include a second electrical connector portion 372 that is coupled to the intermediate panel 126 and is positioned on the opposite side of the intermediate panel 126 from the hinges 132.

The crossflow fan 148 is in electrical communication with the first electrical connector portion 370 and the second electrical connector portion 372. The crossflow fan 148 is configured to operate when the first electrical connector portion 370 and the second electrical connector portion 372 are in electrical contact with each other. For example, the first electrical connector portion 370 and the second electrical connector portion 372 may be configured to be in electrical contact with each other when the intermediate panel 126 is in the closed position such that electrical power is supplied to the crossflow fan 148. Electrical contact between the first electrical connector portion 370 and the second electrical connector portion 372 may close a circuit between the first electrical connector portion 370, the second electrical connector portion 372, and the crossflow fan 148 such that the crossflow fan 148 is configured to operate as described above.

Furthermore, the crossflow fan 148 is configured to stop operating when the first electrical connector portion 370 and the second electrical connector portion 372 are not in electrical contact with each other. For example, the first electrical connector portion 370 and the second electrical connector portion 372 may be configured to not be in electrical contact with each other when the intermediate panel 126 is in the open position such that electric power is not supplied to the crossflow fan 148. Such a position may indicate that the humidifier assembly 100 is being serviced and therefore the crossflow fan 148 does not need to operate.

In some implementations, the first electrical connector portion 370 and the second electrical connector portion 372 may also be in electrical communication with the valve 122. For example, the valve 122 may be configured to limit the supply of water to the top end 118 of the humidifier pad 112 when the intermediate panel 126 is in the open configuration. Furthermore, the valve 122 may be configured to allow water to flow to the top end 118 of the valve 122 when the intermediate panel 126 is in the closed configuration.

In operation, and with reference to FIGS. 1-3, the humidifier assembly 100 may be coupled to the HVAC duct 103. With the intermediate panel 126 in the closed position, electrical power is provided to the crossflow fan 148 (via the electrical connection between the first electrical connector portion 370, the second electrical connector portion 372, and the crossflow fan 148) such that the crossflow fan 148 can operate. The elongate blades 258 rotate around the fan axis 156 to draw air from the HVAC duct 103 through the humidifier pad 112 and into the air flow chamber 142 via the openings 130 in the intermediate panel 126. The air flows toward the second lateral side 146 of the air flow chamber 142 and enters the interior space 260 through the elongate blades 258. The air exits the elongate blades 258 at the outlet area 264 and is directed through the outlet 106 via the flow opening 268 of the flow director 150 and back into the HVAC duct 103. In instances where the humidifier assembly 100 is serviced, the intermediate panel 126 may be rotated away from the chassis 102 to place the humidifier assembly 100 in the open configuration, thereby opening the electrical connection between the first electrical connector portion 370, the second electrical connector portion 372, and the crossflow fan 148 such that the crossflow fan 148 does not operate.

The humidifier assembly 100 disclosed herein may provide improved performance characteristics over humidifiers that implement axial fans, which draw air into the humidifier along an axis parallel to an axial fan axis. For example, the flow opening 268 of the humidifier assembly 100 may be smaller than typical openings in an axial fan humidifier, thereby allowing the humidifier assembly 100 to produce a higher velocity of the air without increasing the flow rate of the air through the crossflow fan 148. In addition, the crossflow fan 148 may generate less noise than an axial fan used in an axial fan humidifier such that the humidifier assembly 100 is quieter than an axial fan humidifier.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A humidifier assembly that is configured to humidify air by flow of the air through a humidifier pad that is formed from a porous material and adapted to absorb water, the humidifier assembly comprising:

a water supply assembly that is configured to supply the water to a top end of the humidifier pad so that the water may flow through the porous material of the humidifier pad from the top end of the humidifier pad toward a bottom end of the humidifier pad;

a chassis configured to be coupled to an HVAC duct, the chassis defining an inlet to receive the air from the HVAC duct and an outlet to return the air to the HVAC duct, wherein the chassis defines a humidifier pad chamber and is configured to support the humidifier pad within the humidifier pad chamber such that a first side of the humidifier pad faces toward the inlet, a second side of the humidifier pad faces away from the inlet, and the chassis is configured to allow the air from the HVAC duct to enter the humidifier pad chamber through the inlet so that the air may flow through the humidifier pad from the first side of the humidifier pad to the second side of the humidifier pad during flow of the air through the humidifier pad chamber to humidify the air by contact of the air with the water in the humidifier pad;

an intermediate panel that is coupled to the chassis and defines openings;

a fan cover coupled to the intermediate panel to define an air flow chamber between the fan cover and the intermediate panel, wherein the air flow chamber extends between a first lateral side and a second lateral side, and the air enters the air flow chamber from the humidifier pad chamber through the openings in the intermediate panel; and a crossflow fan located in the air flow chamber at the second lateral side of the air flow chamber, the crossflow fan extending along a fan axis that is oriented in a generally vertical direction and having elongate blades that extend generally parallel to the fan axis in an array around the fan axis to define an interior space along the fan axis, the crossflow fan being configured to define an inlet area at which the air is drawn from the air flow chamber into the interior space through the elongate blades, and to define an outlet area at which the air is expelled from the interior space toward the outlet through the elongate blades.

2. The humidifier assembly of claim 1, wherein the intermediate panel is coupled to the chassis by hinges that define a generally vertical rotation axis for the intermediate panel to allow the intermediate panel to move with respect to the chassis between a closed position and an open position, and the crossflow fan and the fan cover are coupled to the intermediate panel such that they move with the intermediate panel between the closed position and the open position.

3. The humidifier assembly of claim 2, further comprising a flow director coupled to the fan cover adjacent to the outlet area of the crossflow fan and having a flow opening that is configured to interface with the outlet such that the air is directed from the crossflow fan to the outlet through the flow opening of the flow director.

4. The humidifier assembly of claim 1, wherein a depth of the air flow chamber, measured between the fan cover and the intermediate panel, increases from the first lateral side to the second lateral side of the air flow chamber.

5. The humidifier assembly of claim 1, wherein the crossflow fan is positioned in lateral alignment with the outlet.

6. The humidifier assembly of claim 1, wherein the crossflow fan is laterally offset from the inlet.

7. The humidifier assembly of claim 1, wherein the outlet is rectangularly shaped and a long side of the outlet is oriented in a generally vertical direction.

8. The humidifier assembly of claim 2, wherein the hinges include an upper hinge positioned vertically above a lower hinge and define a vertical space between the upper hinge and the lower hinge.

9. The humidifier assembly of claim 8, wherein a flow director is positioned in the vertical space between the upper hinge and the lower hinge.

10. The humidifier assembly of claim 1, wherein the crossflow fan is configured to pull the air from the HVAC duct such that the air flows through the humidifier pad and is directed to the outlet by the crossflow fan.

11. The humidifier assembly of claim 1, further comprising:

a first electrical connector portion coupled to the chassis;

a second electrical connector portion coupled to the intermediate panel; and a valve in fluid communication with the water supply assembly and in electrical communication with the first electrical connector portion and the second electrical connector portion;

wherein the valve is configured to allow the water to flow to the top end of the humidifier pad when the first electrical connector portion and the second electrical connector portion are in electrical contact with each other, and the valve is configured to limit the water supplied to the top end of the humidifier pad when the first electrical connector portion and the second electrical connector portion are not in electrical contact with each other.

12. A humidifier assembly that is configured to humidify air by flow of the air through a humidifier pad that is formed from a porous material and adapted to absorb water, the humidifier assembly comprising:

a water supply assembly that is configured to supply the water to a top end of the humidifier pad so that the water may flow through the porous material of the humidifier pad from the top end of the humidifier pad toward a bottom end of the humidifier pad;

a chassis configured to be coupled to an HVAC duct, the chassis defining an inlet to receive the air from the HVAC duct and an outlet to return the air to the HVAC duct, wherein the chassis defines a humidifier pad chamber and is configured to support the humidifier pad within the humidifier pad chamber;

an intermediate panel that is coupled to the chassis and defines openings, wherein the intermediate panel is coupled to the chassis by hinges that define a generally vertical rotation axis for the intermediate panel to allow the intermediate panel to move with respect to the chassis between a closed position and an open position, and the hinges include an upper hinge positioned vertically above a lower hinge and define a vertical space between the upper hinge and the lower hinge;

a fan cover coupled to the intermediate panel to define an air flow chamber between the fan cover and the intermediate panel, wherein the air flow chamber extends between a first lateral side and a second lateral side, and the air enters the air flow chamber from the humidifier pad chamber through the openings in the intermediate panel; and a crossflow fan located in the air flow chamber at the second lateral side of the air flow chamber, the crossflow fan extending along fan axis that is oriented in a generally vertical direction and having elongate blades that extend generally parallel to the fan axis in an array around the fan axis to define an interior space along the fan axis, the crossflow fan being configured to define an inlet area at which the air is drawn from the air flow chamber into the interior space through the elongate blades, and to define an outlet area at which the air is expelled from the interior space toward the outlet through the elongate blades;

wherein the crossflow fan and the fan cover are coupled to the intermediate panel such that they move with the intermediate panel between the closed position and the open position.

13. The humidifier assembly of claim 12, wherein a flow director is positioned in the vertical space between the upper hinge and the lower hinge.

14. The humidifier assembly of claim 13, wherein the flow director is coupled to the fan cover adjacent to the outlet area of the crossflow fan and having a flow opening that is configured to interface with the outlet such that the air is directed from the crossflow fan to the outlet through the flow opening of the flow director.

15. The humidifier assembly of claim 12, wherein a depth of the air flow chamber, measured between the fan cover and the intermediate panel, increases from the first lateral side to the second lateral side of the air flow chamber.

16. The humidifier assembly of claim 12, wherein a first side of the humidifier pad faces toward the inlet, a second side of the humidifier pad faces away from the inlet, and the chassis is configured to allow the air from the HVAC duct to enter the humidifier pad chamber through the inlet so that the air may flow through the humidifier pad from the first side of the humidifier pad to the second side of the humidifier pad during flow of the air through the humidifier pad chamber to humidify the air by contact of the air with the water in the humidifier pad.

17. A humidifier assembly that is configured to humidify air by flow of the air through a humidifier pad that is formed from a porous material and adapted to absorb water, the humidifier assembly comprising:

a chassis configured to be coupled to an HVAC duct, the chassis defining an inlet to receive the air from the HVAC duct and an outlet to return the air to the HVAC duct, wherein the chassis defines a humidifier pad chamber and is configured to support the humidifier pad within the humidifier pad chamber such that a first side of the humidifier pad faces toward the inlet, a second side of the humidifier pad faces away from the inlet, and the chassis is configured to allow the air from the HVAC duct to enter the humidifier pad chamber through the inlet so that the air may flow through the humidifier pad from the first side of the humidifier pad to the second side of the humidifier pad during flow of the air through the humidifier pad chamber to humidify the air by contact of the air with water in the humidifier pad;

an intermediate panel that is coupled to the chassis and defines openings;

a fan cover coupled to the intermediate panel to define an air flow chamber between the fan cover and the intermediate panel, wherein the air flow chamber extends between a first lateral side and a second lateral side, and the air enters the air flow chamber from the humidifier pad chamber through the openings in the intermediate panel, wherein a depth of the air flow chamber, measured between the fan cover and the intermediate panel, increases from the first lateral side to the second lateral side of the air flow chamber; and a crossflow fan located in the air flow chamber at the second lateral side of the air flow chamber, the crossflow fan extending along fan axis that is oriented in a generally vertical direction and having elongate blades that extend generally parallel to the fan axis in an array around the fan axis to define an interior space along the fan axis, the crossflow fan being configured to define an inlet area at which the air is drawn from the air flow chamber into the interior space through the elongate blades, and to define an outlet area at which the air is expelled from the interior space toward the outlet through the elongate blades.

18. The humidifier assembly of claim 17, further comprising a water supply assembly that is configured to supply the water to a top end of the humidifier pad so that the water may flow through the porous material of the humidifier pad from the top end of the humidifier pad toward a bottom end of the humidifier pad.

19. The humidifier assembly of claim 18, further comprising:

a first electrical connector portion coupled to the chassis;

a second electrical connector portion coupled to the intermediate panel; and a valve in fluid communication with the water supply assembly and in electrical communication with the first electrical connector portion and the second electrical connector portion;

wherein the valve is configured to allow the water to flow to the top end of the humidifier pad when the first electrical connector portion and the second electrical connector portion are in electrical contact with each other, and the valve is configured to limit the water supplied to the top end of the humidifier pad when the first electrical connector portion and the second electrical connector portion are not in electrical contact with each other.

20. The humidifier assembly of claim 17, wherein the crossflow fan is laterally offset from the inlet.

* * * * *